United States Patent [19]

Neuhaus et al.

[11] Patent Number: 5,012,221

[45] Date of Patent: Apr. 30, 1991

[54] EMERGENCY VEHICLE AUDIBLE WARNING SYSTEM AND METHOD

[75] Inventors: Max Neuhaus, New York; Frederick G. Reinagel, Buffalo, both of N.Y.

[73] Assignee: Siren Sounds, Inc., Englewood Cliffs, N.J.

[21] Appl. No.: 328,407

[22] Filed: Mar. 24, 1989

[51] Int. Cl.[5] ..... G08B 3/00

[52] U.S. Cl. ..... 340/384 E; 340/384 R; 340/329; 340/460; 340/463; 340/474; 340/405; 340/692; 381/86

[58] Field of Search ..... 340/384 R, 384 E, 328, 340/329, 460, 463, 466, 467, 474, 471, 901, 902, 904, 405, 692; 381/73.1, 80-82, 86, 61; 367/197-199

[56] References Cited

U.S. PATENT DOCUMENTS

| | | | |
|---|---|---|---|
| 3,438,028 | 4/1969 | Stewart | 340/384 E |
| 3,493,966 | 2/1970 | Human | 340/327 |
| 3,578,912 | 5/1971 | Beavers et al. | 340/384 E |
| 4,040,050 | 8/1977 | Nunn, Jr. | 340/384 E |
| 4,075,624 | 2/1978 | Sheff | 340/384 E |
| 4,086,589 | 4/1978 | Cieslak et al. | 340/384 E |
| 4,206,448 | 6/1980 | Davis | 340/384 R |
| 4,347,403 | 8/1982 | Schwager et al. | 340/384 E |
| 4,644,327 | 2/1987 | Patterson | 340/384 E |
| 4,646,063 | 2/1987 | Carson | 340/384 E |
| 4,668,938 | 5/1987 | Bosnak | 340/384 E |
| 4,700,390 | 10/1987 | Machiola | 381/61 |
| 4,768,022 | 8/1988 | Patterson | 340/384 E |
| 4,812,746 | 3/1989 | Dallas, Jr. | 340/384 E |

*Primary Examiner*—Donnie L. Crosland

*Attorney, Agent, or Firm*—Brumbaugh, Graves, Donohue & Raymond

[57] ABSTRACT

An emergency vehicle audible warning system and method for improving emergency vehicle mission effectiveness and reducing the undesirable side effects of emergency vehicle audible warning systems. The audible warning system projects different selectable sound phrases that indicate varying levels of urgency. Periods of silence are included between sound phrases for, among other purposes, improving listener attentiveness and allowing operators of emergency vehicles to hear other approaching emergency vehicles. Urgency is further indicated by varying the duration of silent period between sound phrases with speed changes of the emergency vehicle. Higher and broader frequency spectrums compared to typical warning systems are utilized in order to better penetrate other vehicles and to project a less harsh, yet still effective warning. Forward-directional and rear-directed acoustic radiators projecting dissimilar sound phrases cue listeners to whether the emergency vehicle is approaching or departing the listener's vicinity.

46 Claims, 4 Drawing Sheets

EMERGENCY VEHICLE AUDIBLE WARNING SYSTEM AND METHOD

BACKGROUND OF THE INVENTION

This invention relates to defining and projecting sound phrases with qualities for optimizing mission effectivity and reducing undesirable side effects of emergency vehicle (EV) audible warning systems.

Since their advent, motorized vehicles have been adapted and used to transport personnel and equipment for missions categorized as civilian emergencies. These missions include e.g., transporting law-enforcement personnel to the scene of a crime, the transport of firefighters and their equipment to the scene of a fire, the transport of medical personnel and equipment to the scene of an accident, and the transport of accident victims or critically ill patients to a hospital. Since time is of the essence in all of these missions, sirens and systems have been developed for EVs to warn individuals to yield all rights-of-way and to allow free passage. As the size, power and speed of EVs have increased, the possibility of serious damage and bodily injury from a collision with pedestrians or other vehicles (including other EVs) has become a major consideration in the design of warning systems. Certain warning systems are emitters of audible signals which have the advantages of propagating around blind corners and being perceivable from all cranial azimuth angles by human observers. The primary requirement of producing a sound that is loud enough to be heard at a sufficient distance drove the early designs of EV audible warning systems. As EV speed capability increased, so did the necessity for projecting the audible warning signal to increasingly greater distances. This gave rise to hand and motor driven mechanical sirens, and to electrosolenoid and pneumatic driven resonant horns. The limitations of these technologies dominated the properties of the warning sounds, generally characterized by either the continuous wail of the rotary siren, or the alternating high and low pitch tones of a dual horn (European) system.

Modern EV audible warning systems have replaced mechanical sirens, electrically driven klaxon resonators, and pneumatic acoustical energy sources with high power electrodynamic linear transducers (loudspeakers) driven by efficient solid-state electronic amplifiers. However, the traditional warning sounds have become so entrenched that, in spite of the broad capabilities of linear driver/transducer systems, only the historically precedent warning sounds are emulated by present electronic siren systems (with the exception of the rapidly frequency-modulated sound commonly called the "yelp"). No existing commercially produced electronic siren system provides a sound, or class of sounds, specifically designed to optimize the success of the EV mission i.e. get to its destination in the shortest possible time, minimize the risk of collision with pedestrians and other vehicles, and at the same time reduce the negative side effects of audible warning systems as much as possible.

Emergency vehicles presently employ an audible warning system consisting of a sound generator which emits a continuous audible warning signal having a fixed sequence of frequency modulation. In all but electronic siren systems, this program is limited to a single repeating pattern. Electronic siren systems typically provide the means to manually select from among a small number of frequency modulation patterns. However, in no presently existing systems are there means for either manually or automatically controlling other attributes of the warning sound, e.g., tone quality (spectral content), amplitude and frequency pattern time profile, and pattern repetition rate.

The following is an enumeration of significant deficiencies of present siren sounds which compromise the effectivity of an EV's primary mission, and diminish the quality of the urban acoustic environment:

1. Because present warning signals are continuously sounded, the driver of an EV, necessarily subjected to the high intensity of his vehicle's warning sound, cannot hear the approach of other EVs. Since most emergency scenarios involve multiple EVs, often approaching the same point from different directions, this deficiency is manifested in the large number of accidents involving a collision between two EVs.

2. The present warning signals are grossly deficient in the psychoacoustic features which provide directionality (locatability) cues. Presently existing EV audible warning systems provide the observer with very little information about the EV, only that it exists somewhere in a local region and, depending upon the acoustical environment, perhaps some vague idea of the relative direction of the source. With such little information, he cannot assess the degree of impending danger, and therefore cannot react in an appropriate manner to avoid interference with the progress of the EV and to minimize his risk to personal injury and/or property damage.

3. By being forced to assume a worst-case level of danger, the observer is subjected to a substantially higher level of psychological and physical stress than is most often required to take appropriate accident avoidance measures, if, in fact, any at all are required. These higher stress levels may also impair the observer's judgmental abilities so as to frighten and/or confuse him into taking counterproductive responses that would actually increase the risk of accident. The present warning signals result in unnecessary psychological and physiological stresses to the general population (especially those in dense urban environments), the vast majority of whom have no need to alter their behavior to enhance the effectivity of the EV mission.

4. Some of the present warning signals produce highly negative conditioned emotional responses because of their association with the horrors of past wars and events, i.e. air-raid sirens and patrol vehicle high-low horns used during the holocaust.

5. Because present warning signals are continuously sounded, they soon lose the attention of the hearer, being perceptually relegated to the background noise level.

6. Present warning signals subject accident victims or critically ill patients to unnecessarily high stress levels when transported by ambulance.

7. Present warning signals are not optimized in their spectral, temporal, or directional characteristics for the purpose of penetrating to the interiors of other road vehicles in the projected path of the EV. The high road-noise isolation body designs and powerful auto audio entertainment systems of modern private vehicles make this consideration increasing more important.

8. The current noise abatement criteria for judging the annoyance of sounds solely by their loudness is both inadequate and misleading, i.e., it is possible to make soft sounds which are very annoying and loud ones which are quite pleasing. Two extreme examples might be the soft scraping of a fingernail on a blackboard and the sound of a large waterfall at a distance of ten feet. It is clear that the annoyance or pleasantness of a sound is a complex human reaction which relates to many factors including the nature or characteristic of the sound itself and the set of associations we have with it. As it is imperative that EV warning sounds be sufficiently loud in order to reach their intended hearers, a goal of this invention is the design of a set of sound patterns which are both more humane and more effective by the manipulation of other sound parameters.

The primary attribute of the sounds which is exploited and controlled in this concept is a psychological quality herein referred to as urgency. It is the degree of this attribute present in the sound which affects the observer's level of physiological response. High levels of urgency elicit high levels of awareness and autonomically trigger the body's defensive mechanisms (increased pulmonary and coronary rates, etc.); and low levels of urgency cue the observer that little or no response is required, thus sparing him unnecessary stress. The three characteristics of the sound which strongly correlate with subjectively perceived urgency are repetition rate, direction of frequency modulation (that is to say whether the frequency of tones in a phrase is ascending or decending), and relative content of high-frequency components. These characteristics are readily interpretable by the general population as strongly correlative with the sense of urgency without requiring any formal learning process. They are naturally associated with everyday dynamic events involving hazardous levels of speed and energy (e.g., the rate of the sound of railroad wheels crossing a rail joint increases as the train velocity increases, the whine of an engine increases in frequency as it accelerates, the high-frequency hiss steam makes escaping under high pressure, etc.). The essential features of this class of sounds, however, have not been utilized in audible warning systems for EVs. A goal of the invention is an attempt to mediate the urgency of the sound according to the hearer's particular degree of danger.

SUMMARY OF THE INVENTION

The present invention optimizes use of advanced technology, physical attributes of sound, and knowledge of the psychological effects of sound for improving mission effectivity and reducing the undesirable side effects of EV audible warning systems. One of the ways in which the present invention does this is by attention to the urgency of the projected sound phrases.

The present invention includes periods of silence with sounds consisting of repeated phrases. Preferably a period of silence follows each phrase. This feature allows EV drivers to detect the presence of other EVs in the vicinity, aids in cueing observers to the direction of the sound source, diminishes psychological fatigue of the observer, thereby enhancing perceptual threshold to the sound, and reduces the level of psychological stress to the occupants of the EV and to the general public without compromising its functional effectiveness.

The present invention also has the repetition rate of the sound phrase controlled by the speed of the EV. This feature increases the sense of urgency for faster traveling EVs, ensures at least one warning phrase is projected within a predetermined interval of distance, and, through experience, helps observers judge the speed of the EV.

In a preferred embodiment, a speed sensor coupled to the wheels of the EV e.g., the EV's existing speedometer or a specially provided electromagnetic device automatically modifies and controls one or more characteristics of the emitted sound phrase. In the preferred embodiment, the repetition rate is varied. Alternatively, however, the output of the audio waveform generator (be it either acoustical or electrical) can be modulated or modified by the output of the speed sensor in one or more other ways, the output of the speed sensor can be used directly in the process of generating or synthesizing the audio waveform, for example by increasing the frequency of all or part of the sound phrase, by controlling the choice of more or less urgent phrases, or by increasing the amplitude (which is to say loudness or intensity) of the sound.

The observer would learn to estimate the speed of the EV by the characteristics of its emitted sound through experience. However, the learning process and speed discriminability can be significantly enhanced by varying a psychoacoustic attribute of the emitted sound which may be described as "urgency", generally increasing the urgency of the sound as the speed of the EV increases. It is well known that some types of sounds are much more effective in stimulating the "alert" and "alarm" responses in human observers. Higher repetition rates, ascending frequencies, and generally higher frequencies are among these. These types of sounds are said to possess high levels of urgency. On the other hand, decreasing the urgency of the EV's warning sound at slower speeds has the benefit of sparing the general human population unnecessary stress, thereby improving the quality of life in dense urban environments. It does not follow, however, that if in course of reaching its destination, the speed of the EV should necessarily fall to zero to avoid collision, the audible warning should be absent (unarguably the absolute zero of the urgency scale). The EV must still communicate its presence and intention of expeditious motion.

The present invention provides a different tone quality of the sound phrase, that is to say, utilizes a broader frequency spectrum than present EV warning sounds and varies the spectrum shape within each sound phrase. A sound with prominent high frequency components reduces the physiological stress levels of the observer without sacrificing detection threshold, enhances the ability of an observer to determine the direction of the sound source, psychologically elevates the urgency of the sound to observers in proximity to the EV, increases sound penetration into moving vehicles, creates familiar sounds rather than alien synthetic sounds and provides a class of sounds with a distinctive enough character to be readily identifiable as an emergency vehicle.

The present invention provides warning signals having a number of sound phrases with different frequency patterns that can be selected by an operator of the EV. Each different sound phrase projects a different level of urgency. Such a feature allows the operator to warn the general public of the urgency of the present situation while minimizing annoyance to the general public when on less urgent calls.

Warning sounds differently directed from the EV have different characteristics, helping the bearer to locate the EV and recognize what, if any, action should be taken. The warning system of the preferred embodiment of the present invention uses separate front-directed and rear-directed acoustic radiators or speakers having independently generated sound phrases. As compared to the warning sound phrases from the front-directed acoustic radiators, the characteristics of the patterns of the sound phrases projected from the rear-directed acoustic radiators aid in mediating or lessening the sense of urgency to observers in the rear hemisphere of the EV, which is to say, rearward of the EV. It is possible to further refine this concept by further speakers, projecting diferent sound patterns in different directions, as well.

DESCRIPTION OF THE PREFERRED EMBODIMENT

Figure 1:
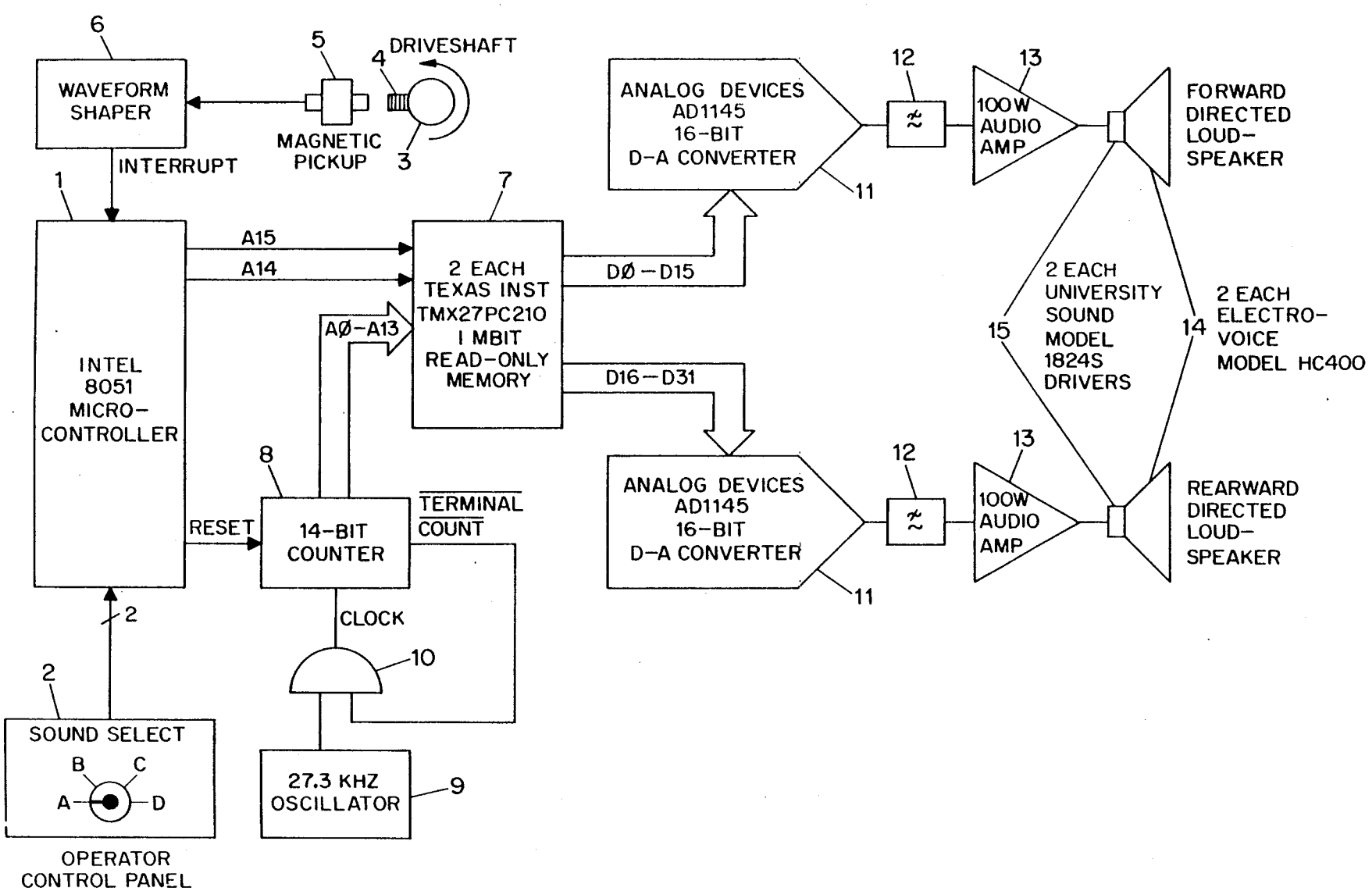
FIG. 1 is a functional block diagram of the emergency vehicle audible warning system.

Referring to the functional block diagram in FIG. 1, the overall operation of the invention is coordinated by microcontroller 1, a device which contains an arithmetic logic unit, instruction set memory, random access memory, interrupt handler, multiple timers, input/output ports, and a user-programmable read only memory. The microcontroller 1 is used to sense various input controls and signals. It performs the required counting and timing functions, and provides output control signals to the sound waveform generating circuitry in a conventional manner well known to one skilled in the art of electronic system design.

One source of input signals to microcontroller 1 is the EV operator's control panel 2 by which the operator may select one of four different warning sound phrases as appropriate to the immediate environment and situation. The setting of a four-position selector switch is binary encoded into two lines which are connected to an input port of microcontroller 1, which is programmed to poll said input port four times each second to sense changes in said selector switch.

Another input to microcontroller 1 provides information as to the distance travelled by the EV by supplying an interrupt signal each time the driveshaft 3 of the EV makes one complete revolution (about once for each two feet of travel). This is accomplished by the action of permanent magnet 4 fastened to the drive shaft, which induces an electrical voltage pulse signal in solenoidal magnetic pickup 5. This signal is processed by a waveform shaper 6 so as to be compatible with the interrupt input to microcontroller 1.

The frequency patterns of the four different and selectable sound phrases for both forward-directed and rearward-directed radiators are stored in digital format in read only memory 7, organized as 64 K words of 32 bits each. This capacity will provide for eight sounds of 0.6 seconds duration at a sample rate of 27,300 samples per second. Which of the four sounds to be produced at any given time is controlled by an output port of microcontroller 1 connected to the two most significant address bits, A14 and A15, of read-only memory 7. The remaining 14 address bits, AO—A13, are connected to the output lines of binary counter 8. An EV warning sound is initiated when a reset command is provided to counter 8 by an output port of microcontroller 1, which placed all stages of counter 8 into a zero state. This reset state also ensures that the TERMINAL COUNT (low-true) signal is in the high state. This enables AND gate 10 to pass the 27.3 kHz signal from oscillator 9 through to the clock input of counter 8. After counting 16,383 clock pulses, the TERMINAL COUNT (low true) output of counter 8 will transition to the low state, disabling AND gate 10, preventing further counting until microcontroller 1 signals the onset of the next sound phrase by issuing a new reset command to counter 8.

Microcontroller 1 is programmed to provide the desired scheduling of warning sound phrases. Specifically, a sound phrase will be initiated for each 50 feet of EV travel as determined by counting the number of interrupts received from the driveshaft rotation sensor system 3, 4, and 5. Since the EV moves two feet per driveshaft rotation, when a count of 25 is reached, a reset command is issued to counter 8, and the interrupt counter (internal to the microcontroller) is returned to zero. This schedule is overridden by a microcontroller timer function which will issue a reset command 3.1 seconds after the previous command if the interrupt counter has not reached a count of 25 by that time. Another microcontroller timer function will delay a reset command so that it will occur no sooner than 0.9 seconds from the previous command. Microcontroller 1 is also programmed to delay commands from operator control panel 2 to select a different sound pattern from read only memory 7 until at least three complete phrases of the last selected sound pattern have been executed. The microcontroller program code required to accomplish these functions is of a most rudimentary nature, and can be easily accomplished by anyone skilled in the art.

A period of silence is effected after each sound phrase. The sound phrase of the specific preferred embodiment has a duration of 0.6 seconds. And the silent period varies from 2.5 to 2 seconds. This interspersion of silent periods improves the effectivity of the EV warning signal and reduces the siren's undesirable side effects by providing "hear-through" perception windows through which EV drivers can detect the presence of other EVs in the vicinity, thereby largely reducing the hazard of EV-EV collisions. The onset of each sound phrase provides to the observer an interaural time-of-arrival difference which is a primary cue to the direction of the source (locatability). In other words, each ear hears the sound begin at slightly different times as the onset passes the hearer. This is not possible with a continuous sound.

The alternating periods of sound and silence diminishes the effect of psychological fatigue that raises the perceptual threshold to the sound. In other words, each phrase recaptures the observers attention and reasserts its authority. Interspersing periods of silence into the warning sound reduces the level of psychological stress to the occupants of the EV and to the general public without compromising its functional effectivity.

By utilizing the magnetic pickup 5, the repetition rate of the sound phrase is controlled by the speed of the EV, typically being about once each 3 seconds for speeds from 0 to 12 mph, linearly increasing to about once per second at a speed of 37.5 mph. In general, this schedule will provide at least one warning phrase for each 50 feet of EV progress within that speed range. This is believed to be a good speed dependent schedule for an urban environment. Other schedules may be desired for other environments, for example in rural settings where higher EV speeds are common. After familiarization, observers will be able to judge the speed of the EV by means of this repetition rate, and thereby adapt appropriate responsive measures to maximize mission effectiveness of the EV and minimize their personal risk.

The output data bus of read only memory 7 is divided into two 16-bit streams, one containing information for the forward-directed sound, and the other, for the rearward-directed sound. A digital synthesizer with a digital output is used to generate the waveform patterns of the four different sound phrases that are to be recorded in ROM. The ROM will then be burned or masked in a conventional fashion, using a series of digital numbers representing the synthesizer output.

These digital data streams are converted into analog voltage signals by identical digital-to-analog converters 11, whose outputs, in turn, are processed by low-pass filters 12 to remove sampling frequency components and harmonics thereof. The resultant signals are provided to the inputs of conventional audio amplifiers 13 which drive high-power loudspeakers 14. These loudspeakers have directional radiation patterns which concentrate the sound along their major axes, most especially the high frequency portions of the audible spectrum. These directional characteristics are beneficial to optimum effectiveness of this invention.

The frequency spectral characteristics of the sound phrases utilize a broad spectrum of harmonic content, greater than present EV warning sounds. Using sound phrases with prominent high-frequency components provides numerous advantages. By distributing the acoustical energy over a broader band of frequencies, the physiological stress levels to an observer is reduced compared to the higher localized stress levels produced by present narrow-band (harmonic poor) sounds without sacrificing detection threshold. Subjectively, observers will characterize the sound as less harsh, less unpleasant, and for very high amplitudes (observers very close to the EV), less painful.

Sounds which are rich in harmonics (contain a wide band of high frequency components) are much easier to locate directionally because of the psychoacoustic mechanism of head shading. This is due to the relative inability of high frequency sound to diffract around objects (in this case, the observers head), thus locating the EV in the lateral hemisphere of the ear hearing the relatively more intense harmonics. This information will enhance the observer's ability to adapt appropriate responsive measures to maximize mission effectiveness of the EV and minimize their personal risk.

The spatial beam width of acoustical radiation from a fixed aperture (i.e. the frontal window of a speaker or horn) narrows with increasing frequency. Therefore, observers closer to the projected path of the EV will experience a proportionally greater degree of the high-frequency content of harmonic-rich warning sound phrases. This quality has the effect of psychologically elevating the urgency of the sound to the observers that are most likely to impede the progress of the EV and/or are in the greatest danger. In addition, these higher frequency components are more successful in penetrating into the interiors of other road vehicles, which is most important in the case of vehicles that are potentially obstructing the projected path of the EV. Manipulation of spectrum allows the creation of sounds which resemble familiar sounds (typically bell-like) rather than the current alien synthetic sounds with their negative associations.

Figure 2A:
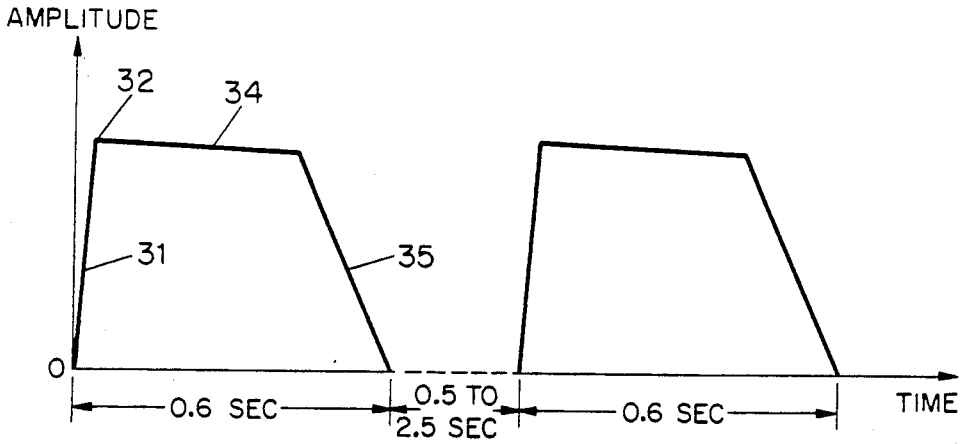
FIG. 2A is a sound amplitude vs time graphical representation of a sound phrase.

FIGS. 2A through 2F are descriptive of exemplary sound phrases with the characteristics of the invention. In FIG. 2A the sound amplitude (intensity) vs time is shown. The length of the phrases are, for example, 0.6 seconds long. It is believed that phrases are best in the range from about 0.5 to about 1 second in duration. The silent window between phrases can be, it is believed, in the range from about 0.3 to about 2.5 seconds in duration. The amplitude of the phrase shows a sharp initial attack at 31, in FIG. 2A, a maximum amplitude at 32, from which the phrase decreases slightly in amplitude at 34 and then tails off sharply at 35. The actual value of the amplitude may depend on local ordinances or other environmental concerns.

Figure 2B:
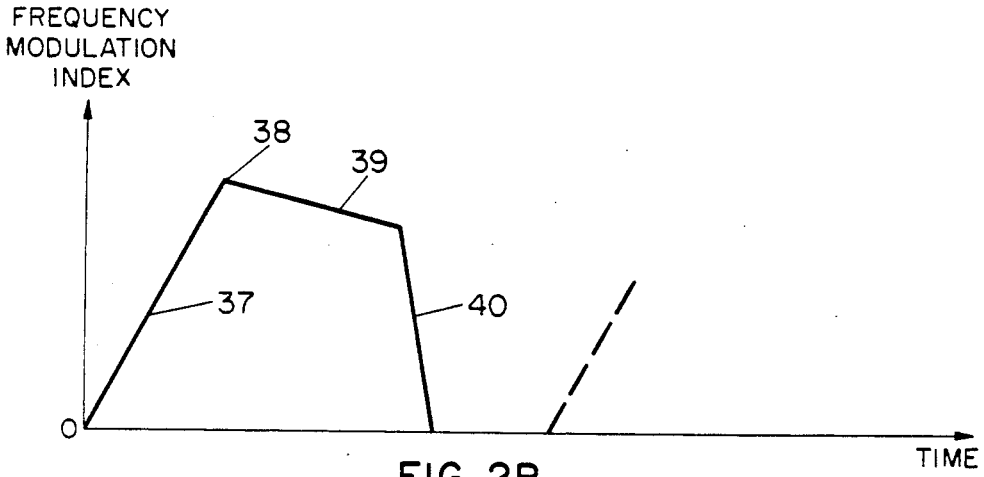
FIG. 2B is a frequency modulation index vs. time graphical representation of the spectral envelope.

As an additional refinement in this embodiment, the spectrum shape of the sound is varied within the phrase. In FIG. 2B the spectral envelope is shown. The fundamental or carrier frequency is frequency modulated by a modulator frequency three times the frequency of the fundamental or carrier frequency. This gives a sound rich in both odd and even harmonics, with peak frequencies four or more times the frequency of the fundamental frequency, depending on the capabilities of the speakers. Typical frequencies are given below in connection with FIGS. 2C through 2F. Components in excess of 2,000 Hz. give good penetration for the purpose of enabling drivers in well sound-proofed cars, or drivers using sound equipment, to notice the presence of emergency vehicles. The degree of modulation gradually increases with the modulation index to a maximum indicated by the value "1." Zero modulation index, at the start of the phrase means that only the fundamental or carrier frequency is present, unmodulated by the modulator frequency. The degree of modulation, i.e. the amount by which the carrier frequency is modulated by the modulator frequency increases to the maximum as indicated at 37. Starting at 0 modulation assists in providing a clear attack as shown at 31 in FIG. 2A. Gradually adding frequency modulation at a modulating frequency three times that of the fundamental allows the creation of of a bell-like timbre, which is more pleasing than the conventional square wave waveform presently in use. From the maximum modulation 38 represented by a modulation index of unity, the degree or amount of modulation decreases gradually as shown at 39 and then drops off rapidly at the end of the phrase to 0 again as indicated by the line 40.

Figure 2C:
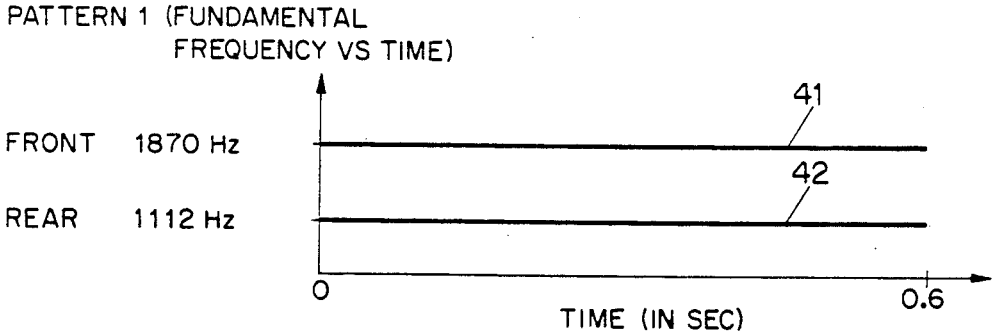
FIGS. 2C-2F are time-frequency graphical representation of the four front-directed frequency patterns and their corresponding rear-directed frequency patterns.
Figure 2D:
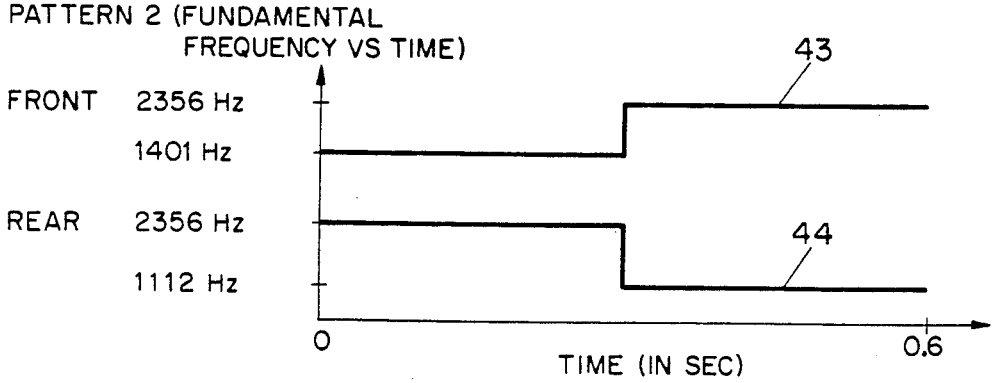
Figure 2E:
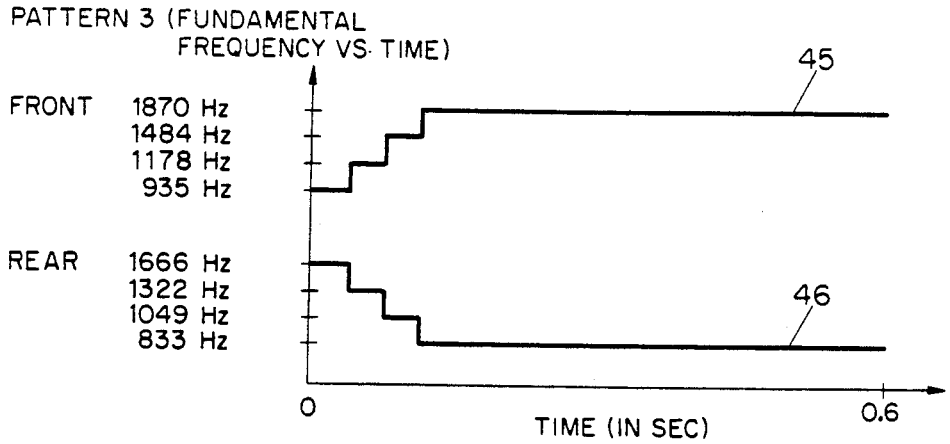
Figure 2F:
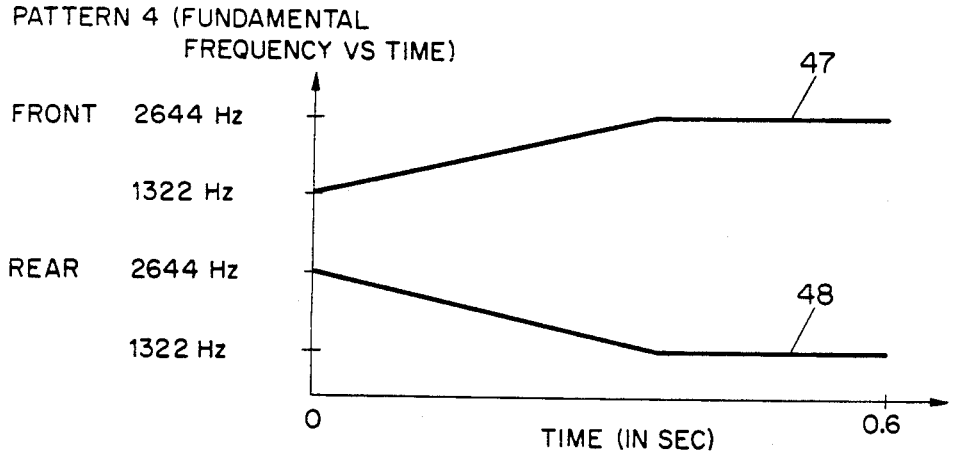

Four frequency patterns are formed using conventional frequency modulation techniques. All four patterns have approximately the same loudness and spectral envelopes. They differ in their changes of frequency over time as shown in FIG. 2C through 2F. The temporal program of the fundamental frequency of the sound within the phrase is varied to form different levels of urgency. The least urgent sound phrase 41 is shown in FIG. 2C and consists of fixed fundamental frequency (but whose harmonic content may be varied within the phrase). The frequency used is 1870 Hz. The next more urgent sound phrase 43, shown in FIG. 2D, consists of an initial tone at a fundamental frequency of 1401 Hz which instantaneously changes to a higher-pitched fundamental tone of 2356 Hz at mid phrase. A typical frequency ratio of the two tones is 1.5. The second most urgent sound phrase 45, shown in FIG. 2E, consists of a sequence of four ascending fundamental pitches, each typically about 1.4 times the frequency of the previous tone. In this case the durations of the first three tones of 935 Hz, 1178 Hz and 1484 Hz are significantly shorter than the final tone of 1870 Hz. The most urgent sound phrase 47, shown in FIG. 2F, consists of a continuously up-ramped pitch traversing a typical frequency ratio of 1:2 for nominally 60% of the phrase duration, with the final pitch sustained for the remainder of the phrase. In this embodiment, the starting up-ramp fundamental frequency is 1322 Hz with the frequency exponentially increasing to 2644 Hz. This gives an apparent linear increase in pitch.

This sound selection feature allows the EV operator to tailor the psychological impact of his warning signal to the immediate situation. It allows him to increase the urgency of the warning sound when faced with situations which threaten to diminish his mission effectiveness, or those of increased risk to public safety. On the other hand, he can decrease the level of urgency when appropriate to improve quality of the urban acoustic environment (e.g., when traffic is sparse during normal sleeping hours). To establish a more controlled psychoacoustic response in the population of observers, the system constrains the manual selection process by repeating a given urgency level sound at least three times before changing to a different selected level.

Figure 3A:
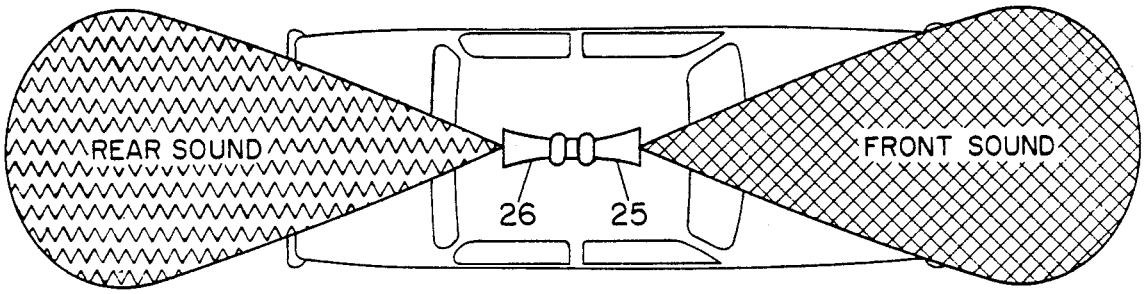
FIG. 3A is a diagramatic top plan view of speakers affixed to the roof of an emergency vehicle showing the pattern of sound propagation.
Figure 3B:
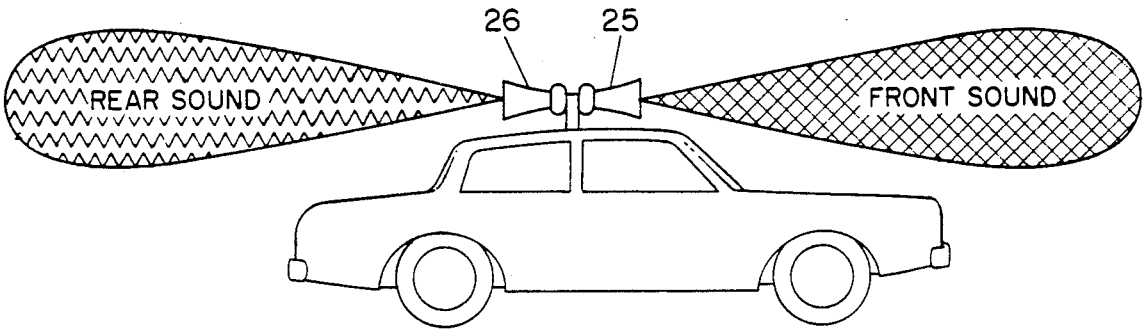
FIG. 3B is a diagramatic side elevation view of speakers affixed to the roof of an emergency vehicle showing the pattern of sound propagation.

As shown in FIG. 3, the preferred warning system uses a separate front-directed and rear-directed acoustic radiators 25 and 26, respectively, having independently generated sounds. The acoustic radiators are preferably highly directional speakers comprised of the Electrovoice Model HC-400 horn and the University Sound Model 1824S heavy duty driver. In this embodiment, a typical scheme would be to generate temporal phrase programs for the rearward-directed radiated similar to those described above, but whose pitches generally decrease throughout the phrase, rather than increase. The least urgent rear-directed sound phrase 42, shown in FIG. 2C, utilizes a fundamental frequency of 1112 Hz. The next more urgent rear-directed sound phrase 44, shown in FIG. 2D, utilizes an initial fundamental frequency of 2356 Hz with a mid-phrase step decrease in frequency to 1112 Hz. The second most urgent rear-directed sound phrase 46 shown in FIG. 2E has short stepped down fundamental frequencies of 1666 Hz, 1322 Hz and 1049 Hz, respectively, followed by a relatively longer time interval at 833 Hz. The most urgent rear-directed sound phrase 48 shown in FIG. 2F has a decreasing ramp starting at 2644 Hz and ending at 1322 Hz. This design provides the attribute of mutual masking, i.e., the ability of the marginally louder sound (by virtue of the directional characteristics of the radiators) to capture the attention of the listener and psychologically desensitize him to the weaker sound. Masking can be enhanced in the case of relatively short duration phrases of monotonic pitch variations such as the ones described above. This is because of the perceptual phenomenon of grouping a limited set of associated stimuli into a single entity called a pattern or phrase. Human observers learn to recognize such patterns in a single cognitive process rather than by multi-step synthesis. It is this same pattern recognition mechanism which allows us to immediately interpret the meaning of a word without being aware of its individual letters. Applying this principle to this case, masking is enhanced because the stronger sound is perceived as an integrated pattern, rather than because each component of the stronger sound completely covers the stimulus of the weaker sound.

The reversal of pitch modulation direction, descending frequencies rather than ascending coupled with the masking effect, dramatically reduces psychologically perceived level of urgency for observers in the rear hemisphere of the EV, informing them that no response is required of them. This, at least statistically, spares half of the proximate population from the stress of deciding on what means of reaction to employ to effectively preserve personal safety.

Applying the assumption that the motion of the EV is essentially forward along its longitudinal axis, the observer can then easily ascertain whether the EV is approaching him or moving away from him. This is accomplished by using two sound sources each capable of emitting separate and distinctly different sounds in a spatially directional manner. FIG. 3 shows one possible arrangement of sound sources on an EV and a representation of two different sound spatial patterns, one directed toward the front of the vehicle and one directed toward the rear. The sound patterns depicted in FIG. 3 are not meant to imply that no sound is heard outside the shaded areas, but instead, represent a locus of constant loudness, with less intense sound fields lying outside the shaded areas. Typically, the forward and rearward-directed sounds will have equal intensities along a direction perpendicular to the longitudinal axis of the EV.

The observer learns to discriminate between the forward- and rearward-directed sound characteristics by experience. However, the learning process and discriminability can be significantly enhanced by employing two sounds having a high degree of difference in a psychoacoustic attribute which may be described as "urgency", the sound having the greater degree of urgency being used for the forward-directed sound. It is well known that some types of sounds are much more effective in stimulating the "alert" and "alarm" responses in human observers. These types of sounds are said to possess high levels of urgency. Using a sound having a low degree of urgency for the rearward-directed sound such as the decreasing frequency patterns discussed above has the benefit of sparing the general human population unnecessary stress, thereby improving the quality of life in dense urban environments.

Figure 4A:
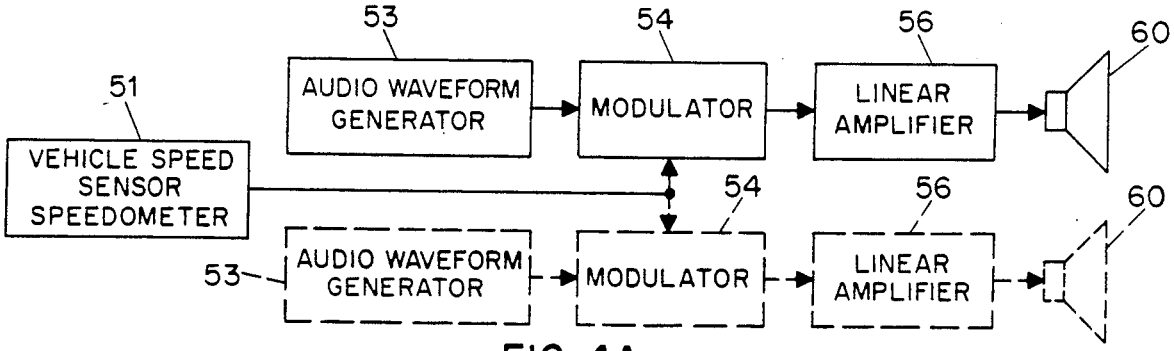
FIGS. 4A and 4B are diagramatic illustrations of methods of varying urgency of emitted sound dependent on vehicle speed.
Figure 4B:
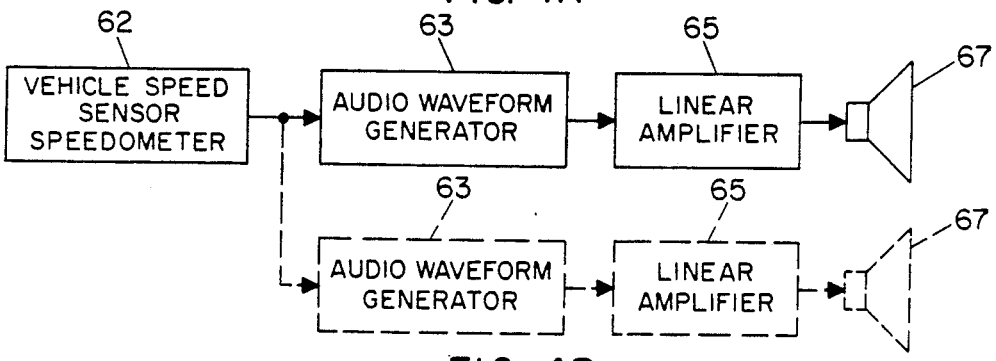

Variation of the urgency of the emitted sound dependent on vehicle speed can be accomplished in more than one way. FIGS. 4A and 4B illustrate this. In FIG. 4A a vehicle speed sensor or speedometer 51 alters the frequency of a phrase produced by one or more audio waveform generators 53, using one or more modulators 54. This is followed by amplification by amplifier(s) 56 and emission from speaker(s) 60. For example, the frequencies of a phrase can be increased for greater urgency. In FIG. 4B the sensor or speedometer 62 directly alters the phrase at the waveform generator(s) 63 prior to amplification at amplifier(s) 65 and emission by the speakers 67. For example, the phrase can be shaped to have ascending frequencies for greater urgency.

Figure 5:
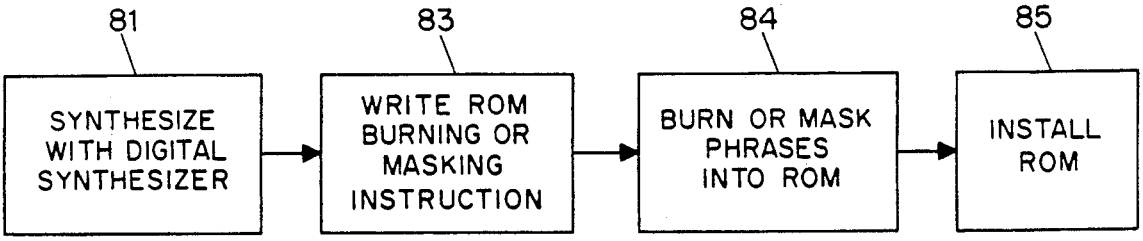
FIG. 5 is a diagram of steps in a method for storing the sound phrases in ROM.

FIG. 5 illustrates the steps of producing the desired sound phrases of the patterns of sound described above. First, using a digital synthesizer at 81, a digital ouput representative of each of the above-described sound patterns is produced. These are then rewritten as ROM burning or masking instructions, at 83, as is well-known in the electronics industry. At the appropriate addresses, the various phrase patterns are burned into ROM, at 84, again conventionally. The ROM is then connected into the equipment, such as that of FIG. 1, as indicated at 85, whereby the exact desired sound patterns are reproducible by correctly addressing the ROM.

Although the basic concept of this invention is not limited to any particular type of sound generating mechanism, including but not limited to rotating mechanical, pneumatic, and electro-mechanical, the preferred embodiment is realized using electronic signal generating means, linear electronic amplification means, and linear electrodynamic transduction means. By these means, the fullest degree of freedom is available to generate any type and quality of sound in order to optimize and tailor the parameters of mutual masking and urgency. While preferred specific embodiments of the invention have been described, these should not be construed as limiting the scope of the invention, as set forth in the appended claims.

We claim:

1. An audible warning system for an emergency vehicle, having sound projection means for emitting warning sound externally of the vehicle to persons in the vicinity of the vehicle, and means for defining a plurality of sound phrases to be projected, the means for defining comprising means for automatically interspersing a period of silence between said sound phrases, whereby vehicle personnel are enabled to hear warning sounds from exterior of the vehicle.

2. An audible warning system for an emergency vehicle according to claim 1 wherein said means for defining a plurality of sound phrases comprises a memory for storing said sound phrases.

3. An audible warning system for an emergency vehicle according to claim 2 wherein said means for defining sound phrases further comprises means for signalling said memory to initiate projection of a next sound phrase.

4. An audible warning system for an emergency vehicle according to claim 3 wherein said signalling means is a counter.

5. An audible warning system for an emergency vehicle according to claim 4 wherein said means for defining further comprises controlling means for resetting said counter and for controlling said period of silence.

6. An audible warning system for an emergency vehicle according to claim 5 wherein said controlling means is a microcontroller.

7. An audible warning system for an emergency vehicle having projection means according to claim 1, and means for defining a plurality of sound phrases, said sound phrases comprising a fundamental acoustic tone and prominent higher frequency acoustic tones that are both odd and even harmonics of the fundamental tone.

8. An audible warning system for an emergency vehicle according to claim 7 wherein said plurality of sound phrases are stored in a memory.

9. An audible warning system for an emergency vehicle capable of moving at a plurality of speeds, comprising sound projection means, and means for defining a plurality of sound phrases having a pattern repetition rate, said means for defining said sound phrases automatically varying said pattern repetition rate independently of phrase content in accordance with changes in the speed of said emergency vehicle.

10. An audible warning system for an emergency vehicle according to claim 9 wherein said pattern repetition rate is directly proportional to said speed of said emergency vehicle.

11. An audible warning system for an emergency vehicle according to claim 10 wherein said means for defining comprises a memory for storing said sound phrases.

12. An audible warning system for an emergency vehicle according to claim 11 wherein said means for defining further comprises speed sensing means for determining the speed of said emergency vehicle.

13. An audible warning system for an emergency vehicle according to claim 12 wherein said means for defining further comprises controlling means having an input from said speed sensing means, for varying said pattern repetition rate of said sound phrases in accordance with the input from said speed sensing means.

14. An audible warning system for an emergency vehicle according to claim 13 wherein said controlling means is a microcontroller.

15. An audible warning system for an emergency vehicle according to claim 14 wherein said speed sensing means comprises a magnetic pickup device for counting revolutions of a driveshaft of said emergency vehicle.

16. An audible warning system for an emergency vehicle, having sound projection means, and means for defining a plurality of sound phrases, said sound projection means comprising a front-directed acoustic radiator and a rear-directed acoustic radiator for simultaneously projecting said sound phrases in opposite directions, said means for defining being connected to provide projection of differing sound phrases from the front-directed and the rear-directed acoustic radiators.

17. An audible warning system for an emergency vehicle according to claim 16 wherein said sound projection means channel said sound phrases directed to said rear-directed acoustic radiator such that rear-directed sound phrases are dissimilar but related to their corresponding sound phrases directed to said front-directed acoustic radiator.

18. An audible warning system for an emergency vehicle according to claim 17 wherein said means for defining comprises a memory for storing said sound phrases.

19. An audible warning system for emergency vehicles including means for defining a series of audible phrases, said phrases having a fundamental frequency that is frequency modulated by a modulation frequency that exceeds the frequency of the fundamental frequency, the degree of modulation of each phrase varying with time, and means for emitting the phrases.

20. An audible warning system of claim 19 wherein each phrase varies in amplitude with time.

21. An audible warning system for emergency vehicles according to claim 19 wherein the modulation frequency is at least three times the fundamental frequency.

22. The audible warning system for emergency vehicles according to claim 19 wherein the fundamental frequency is in excess of 2,000 Hz.

23. The audible warning system for emergency vehicles according to claim 19 wherein the amplitude, modulation frequency and fundamental frequency of at least a portion of the phrases varies with time.

24. The audible warning system for emergency vehicles according to claim 19 wherein the degree of modulation varies from substantially zero to a maximum within a phrase.

25. An audible warning system for an emergency vehicle, having sound projection means, and means for defining a plurality of sound phrases, said sound projection means comprising a front-directed acoustic radiator and a rear-directed acoustic radiator and a rear-directed acoustic radiator for simultaneously projecting said sound phrases in opposite directions, a source of sound phrases of increasing frequency connected to the front-directed acoustic radiator and a source of sound phrases of decreasing frequency connected to the rear-directed acoustic radiator, whereby a greater sense of urgency is projected to persons forward of the vehicle than to persons rearward of the vehicle.

26. An audible warning system for emergency vehicles including means for defining a series of audible phrases, said phrases having a fundamental frequency that is frequency modulated by a modulation frequency, the degree of modulation of each phrase varying with time, and means for emitting the phrases, wherein the fundamental frequency of at least a portion of the phrases varies with time.

27. The method of audible warning including providing sound emitting equipment for warning persons external of an emergency vehicle, producing a series of audible phrases, automatically providing at least one quiet period among said phrases as a regular repeated portion of a program of warning sounds, whereby vehicle personnel proximate the equipment are able to hear remote audible warnings.

28. The method of audible warning according to claim 27, including altering at least one frequency during the course of at least one phrase.

29. The method of emergency vehicle audible including providing sound emitting equipment, providing a plurality of series of phrases of varying sound characteristics alternately selectable for use in situations of greater and lesser urgency, automatically providing in each of said series of phrases interspersed periods of substantial quiet, defining hear-through windows enabling emergency vehicle personnel to hear audible warnings from other vehicles.

30. The method of audible warning including providing sound emitting equipment providing a first series of phrases for emission forward of an emergency vehicle, providing a second series of phrases for emission rearward of the vehicle, the first series of phrases having at least one characteristic differing from the second series of phrases, whereby said first series of phrases has a recognizable urgency greater than said second series.

31. The method of audible warning for an emergency vehicle including the steps of providing sound emitting equipment, sensing the speed of the vehicle, varying at least one frequency-independent component of an audible warning sound in dependence upon the speed of the vehicle, whereby said warning sound has a recognizable greater and lesser urgency resulting from the variation of said component.

32. The method of making an emergency vehicle audible warning system sound pattern for broadcast externally of an emergency vehicle including synthesizing a series of audible phrases and substantially quiet periods, converting the phrases and quiet periods to a memory preparation instruction set, providing a programmable memory programming the memory from the instruction set to provide a series of memory contents corresponding to said series of audible phrases and quiet periods enabling emergency vehicle personnel to hear audible warnings from other vehicles.

33. An emergency vehicle warning system including a sound projection means mounted on a vehicle, the sound projection means comprising a horn type speaker having a highly directional projecting characteristic such that the amplitude of sound projection therefrom is significantly greater in an area centered on an axis of projected sound and significantly lesser outside the area thus centered, the projection means being mounted on a vehicle such that the axis of the projected sound extends in a direction forward of the vehicle substantially in the direction of vehicle travel, whereby persons located forward of the vehicle in the direction of travel of the vehicle experienced a higher level of warning sound than persons located along the side of the roadway on which the emergency vehicle is travelling.

34. An audible warning system for an emergency vehicle capable of moving at a plurality of speeds, comprising sound projection means and means for defining a plurality of distinct sound phrases, said means for defining said sound phrases automatically varying at least one frequency-independent characteristic of said sound phrases in accordance with changes in the speed of said emergency vehicle, whereby a varying sense of urgency is imparted in relation to varying vehicle speeds.

35. An audible warning system for an emergency vehicle according to claim 34 wherein said characteristic is the amplitude of said sound phrases.

36. An audible warning system for an emergency vehicle according to claim 34 wherein said characteristic is the repetition rate of said sound phrases.

37. An audible warning system for an emergency vehicle according to claim 34 wherein said characteristics is varied generally proportional to said speed of said emergency vehicle.

38. An audible warning system for an emergency vehicle according to claim 34 wherein said means for defining comprises a memory for storing said sound phrases.

39. An audible warning system for an emergency vehicle according to claim 38 wherein said means for defining further comprises speed sensing means for determining the speed of said emergency vehicle.

40. An audible warning system for an emergency vehicle according to claim 39 wherein said means for defining further comprises controlling means having an input from said speed sensing means, for varying said characteristic of said sound phrases in accordance with the input from said speed sensing means.

41. An audible warning system for an emergency vehicle according to claim 40 wherein said controlling means is a microcontroller.

42. An audible warning system for an emergency vehicle according to claim 41 wherein said speed sensing means comprises a magnetic pickup device for counting revolutions of a driveshaft of said emergency vehicle.

43. An audible warning system for an emergency vehicle according to claim 34 comprising means for automatically selecting one of said phrases in accordance with changes in the speed of said emergency vehicle.

44. An audible warning system for an emergency vehicle according to claim 43 wherein said means for defining further comprises controlling means having an input from said speed sensing means, for selecting one of said sound phrases in accordance with the input from said speed sensing means.

45. An audible warning system for an emergency vehicle according to claim 44 wherein said controlling means is a microcontroller.

46. An audible warning system for an emergency vehicle according to claim 45 wherein said speed sensing means comprises a magnetic pickup device for counting revolutions of a driveshaft of said emergency vehicle.

* * * * *